US007847176B2

(12) United States Patent
Sugawara

(10) Patent No.: US 7,847,176 B2
(45) Date of Patent: Dec. 7, 2010

(54) DIGITAL SIGNAL PROCESSOR AND A METHOD FOR PRODUCING HARMONIC SOUND

(75) Inventor: Keitaro Sugawara, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 150 days.

(21) Appl. No.: 12/294,305

(22) PCT Filed: Mar. 27, 2007

(86) PCT No.: PCT/JP2007/056442

§ 371 (c)(1),
(2), (4) Date: Sep. 24, 2008

(87) PCT Pub. No.: WO2007/116755

PCT Pub. Date: Oct. 18, 2007

(65) Prior Publication Data

US 2009/0165635 A1 Jul. 2, 2009

(30) Foreign Application Priority Data

Mar. 30, 2006 (JP) ..... 2006-093092

(51) Int. Cl.
*G10H 1/06* (2006.01)

(52) U.S. Cl. ..... 84/622; 381/61

(58) Field of Classification Search ..... 84/622, 84/698; 381/61

See application file for complete search history.

(56) References Cited

U.S. PATENT DOCUMENTS

| | | | | |
|---|---|---|---|---|
| 5,578,948 | A | 11/1996 | Toyama | |
| 6,134,330 | A * | 10/2000 | De Poortere et al. | 381/61 |
| 2002/0061109 | A1 * | 5/2002 | Aarts | 381/61 |
| 2006/0080087 | A1 * | 4/2006 | Vandali et al. | 704/207 |

FOREIGN PATENT DOCUMENTS

| | | | |
|---|---|---|---|
| JP | 54-3724 | B2 | 2/1979 |
| JP | 62-146313 | U | 9/1987 |
| JP | 04-355795 | A | 12/1992 |
| JP | 05-006177 | A | 1/1993 |
| JP | 11-509712 | A | 8/1999 |
| WO | 97/42789 | A1 | 11/1997 |
| WO | WO 2005112508 | A1 * | 11/2005 |

* cited by examiner

*Primary Examiner*—Jianchun Qin
(74) *Attorney, Agent, or Firm*—Sughrue Mion, PLLC

(57) ABSTRACT

In a digital signal processor to perform digital signal process with respect to a music signal and to suppress a signal level to a maximum value when the signal level over the maximum value of processable values is generated by the digital signal processor, a first level correcting device corrects the signal level by multiplying the signal level of the music signal by a correction coefficient so as to make the signal level of the music signal over the maximum value, and a second level correcting device corrects the signal level by multiplying the signal level of the music signal corrected by the first level correcting device by a reciprocal of the correction coefficient.

3 Claims, 9 Drawing Sheets

FIG. 10A
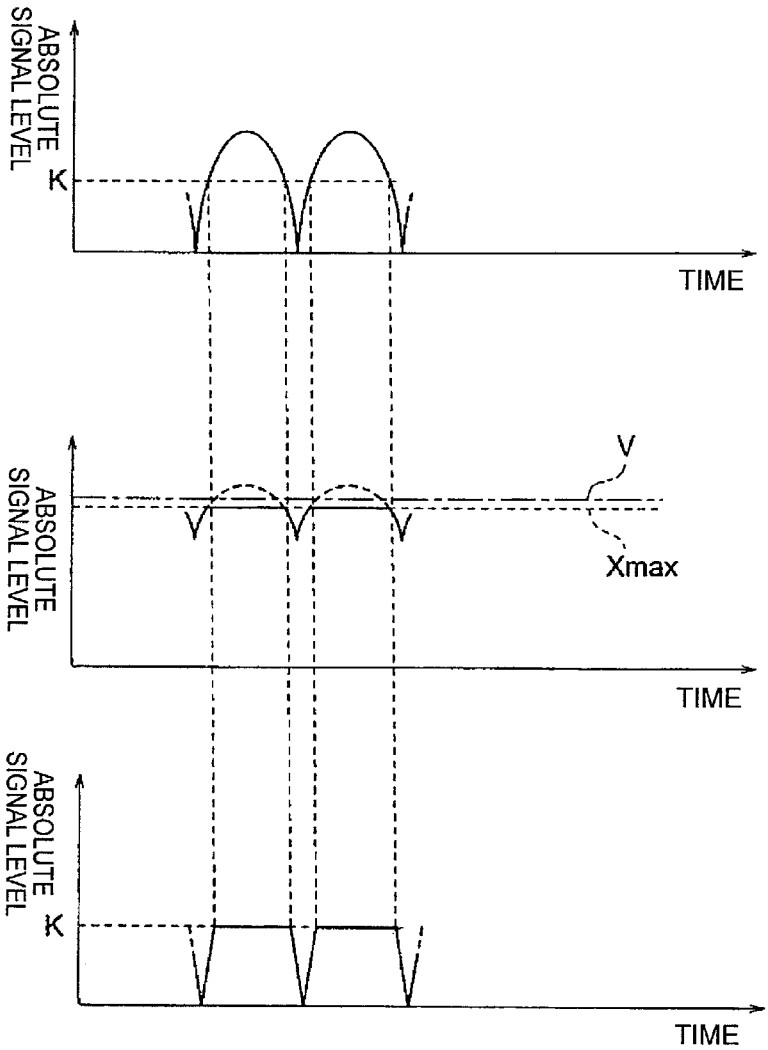
FIG. 10B
FIG. 10C
FIG. 10D
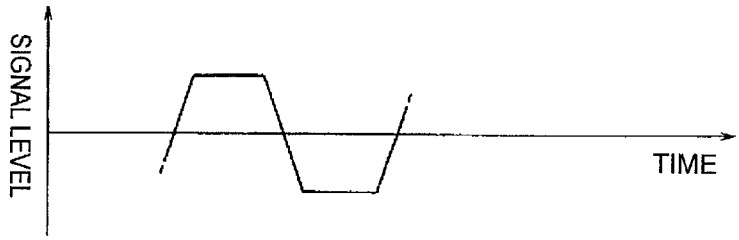

DIGITAL SIGNAL PROCESSOR AND A METHOD FOR PRODUCING HARMONIC SOUND

CROSS-REFERENCE TO RELATED APPLICATIONS

This application claims the benefit of PCT/JP2007/056442.

BACKGROUND OF THE INVENTION (1) Field of the Invention

This invention relates to a digital signal processor and a method for producing harmonic sound.

(2) Description of Related Art

In compressed music signals such as MP3 or WMA, a high frequency range to which a human hardly listen is cut for reducing its file size. Therefore, there is a problem that sound is deteriorated by compression of music signals. Accordingly, a harmonic sound generator is proposed for restoring the high frequency range by generating harmonic sound from the music signals.

A conventional harmonic sound generator uses a compressor having an input-output characteristic shown in FIG. 1. As shown in FIG. 1, when an input signal is less than a specific value A, the compressor outputs linearly, and when the input signal is more than the specific value A, the compressor outputs the specific value A. Accordingly, When a sine wave music signal shown in FIG. 2A is inputted into the compressor, the compressor outputs a music signal of which range over the specific value A is distorted as shown in FIG. 2B. FIG. 3 shows a relationship between a frequency and a signal level of the music signal shown in FIG. 2B. As it is clear from FIG. 3, the music signal shown in FIG. 2B includes harmonic sound components $2f_1$, $3f_1$, $4f_1$, and the like in addition to a frequency $f_1$ of the original music signal.

Further, using a DSP (digital signal processor) instead of the compressor is also proposed to generate the harmonic sound by converting the signal level of the music signal according to a non-linear function the same as the input-output characteristic shown in FIG. 1 (See Patent Document 1).

Patent Document 1: Japanese Published Patent Application No. H05-6177

However, there is a problem that according to a method for generating harmonic sound as described above, the harmonic sound cannot be generated on the basis of the music signal of which signal level is less than the specific value A. There is also a problem that a non-linear input-output device such as the compressor is necessary, thereby a scale of a circuit is increased.

Further, according to the conventional method for generating harmonic sound as described above, the harmonic sound is generated on the basis of all the frequencies included in the music signal. Therefore, there is a problem that it is impossible that harmonic sound on the basis of only a vocal frequency range is generated to emphasize vocal sound.

Accordingly, an object of the present invention is to provide a digital signal processor and a method for generating harmonic sound so as to surely and simply generate harmonic sound on the basis of even a music signal with a small signal level.

Another object of the present invention is to provide a digital signal processor and a method for generating harmonic sound so as to emphasize a music signal of a specific frequency range.

BRIEF SUMMARY OF THE INVENTION

According to claim 1 of the present invention, there is provided a digital signal processor to perform digital signal process with respect to a music signal and to suppress a signal level to a maximum value when the signal level over the maximum value of processable values is generated by the digital signal processor, said digital signal processor comprising:

a first level correcting device to correct the signal level and generate harmonic sound by multiplying the signal level of the music signal by a correction coefficient so as to make the signal level of the music signal over the maximum value; and a second level correcting device to correct the signal level by multiplying the signal level of the music signal corrected by the first level correcting device by a reciprocal of the correction coefficient wherein the first level correcting device includes:

a first correction coefficient multiplying device to multiply the signal level of the music signal by a first correction coefficient;

a second correction coefficient multiplying device to further multiply the signal level multiplied by the first correction coefficient by a predetermined second correction coefficient; and a coefficient correcting device to correct the first correction coefficient so as to make a difference between the signal level multiplied by the first correction coefficient and a predetermined target value divided by the second correction coefficient zero.

According to claim 3 of the present invention, there is provided a method for generating harmonic sound by using a digital signal processor to perform digital signal process with respect to a music signal and to suppress a signal level to a maximum value when the signal level over the maximum value of processable values is generated by the digital signal processor, said method comprising the steps of a first step to generate the harmonic sound by correcting a signal level by multiplying the signal level of a music signal by a correction coefficient so as to make the signal level of the music signal over the maximum value; and a second step to correct the signal level by multiplying the signal level of the music signal in which harmonic sound has been generated by a reciprocal of the correction coefficient wherein in the first step, the digital signal processor multiplies the signal level of the music signal by a first correction coefficient, and further multiplies the signal level multiplied by the first correction coefficient by a second correction coefficient, and corrects the first correction coefficient so as to make a difference between the signal level multiplied by the first correction coefficient and a predetermined target value divided by the second correction coefficient zero.

BRIEF DESCRIPTION OF THE SEVERAL VIEWS OF THE DRAWINGS

FIG. 10A A graph showing a signal level of a music signal before a first level correcting device 11*a* corrects the signal level.

FIG. 10B A graph showing the signal level of the music signal after the first level correcting device 11*a* corrects the signal level.

FIG. 10C A graph showing the signal level of the music signal after a second level correcting device 13 corrects the signal level.

FIG. 10D A graph showing the signal level of the music signal after a second level correcting device 13 corrects the signal level.

EXPLANATIONS OF LETTERS OR NUMERALS

A specific value $X_{max}$ maximum value first level correcting device

11*a* first correction coefficient multiplying device

11*b* second correction coefficient multiplying device

11*c* coefficient correcting device

13 second level correcting device

14 first filter (first extracting device)

15 second filter (second extracting device)

16 adding device

103 DSP (harmonic sound generating device)

DETAILED DESCRIPTION OF THE INVENTION

Figure 4:
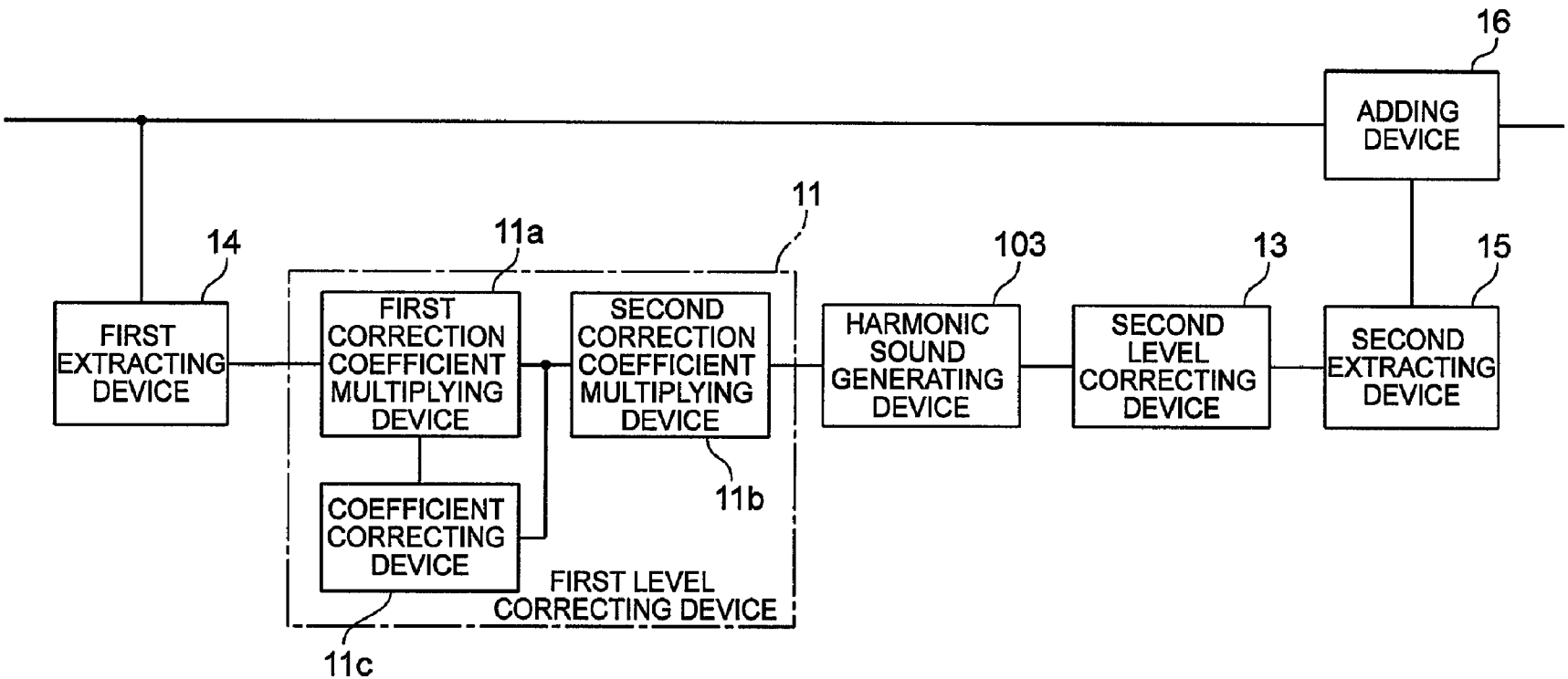
FIG. 4 A configuration diagram showing an example of a basic configuration of a harmonic sound generator according to the present invention.
Figure 5:
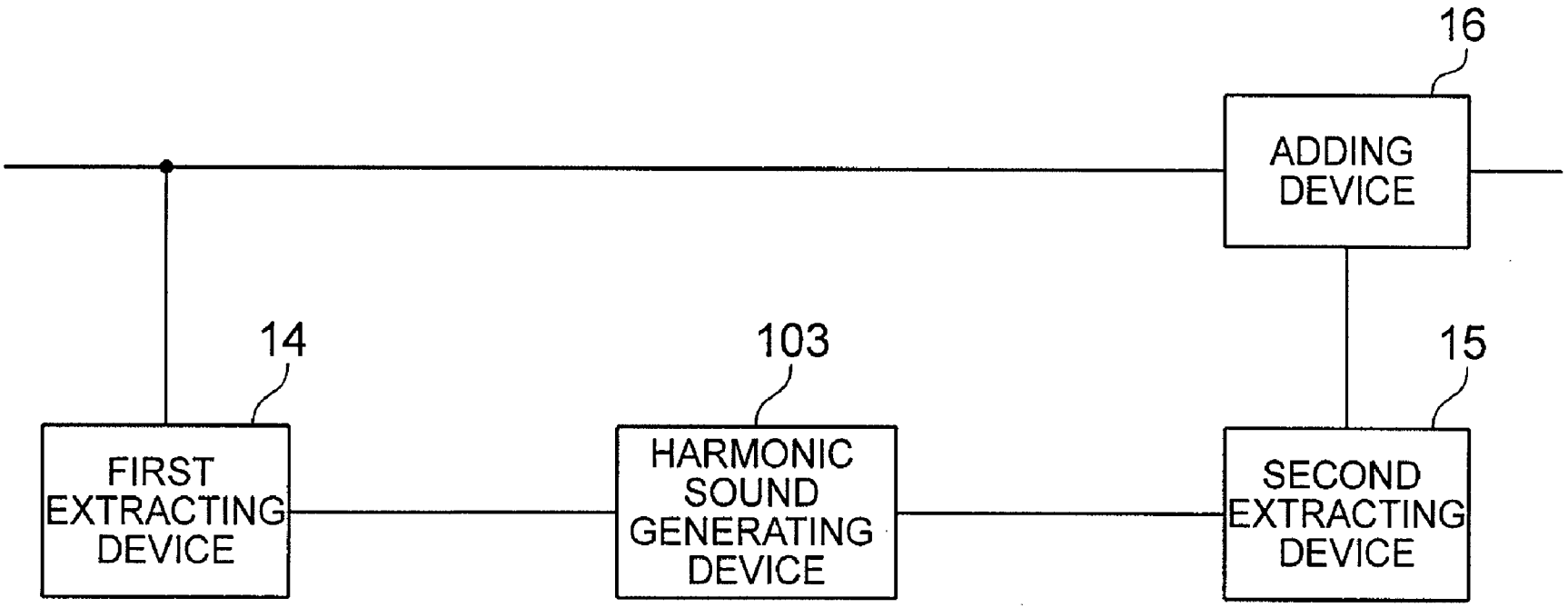
FIG. 5 A configuration diagram showing another example of a basic configuration of a harmonic sound generator according to the present invention.
Figure 6:
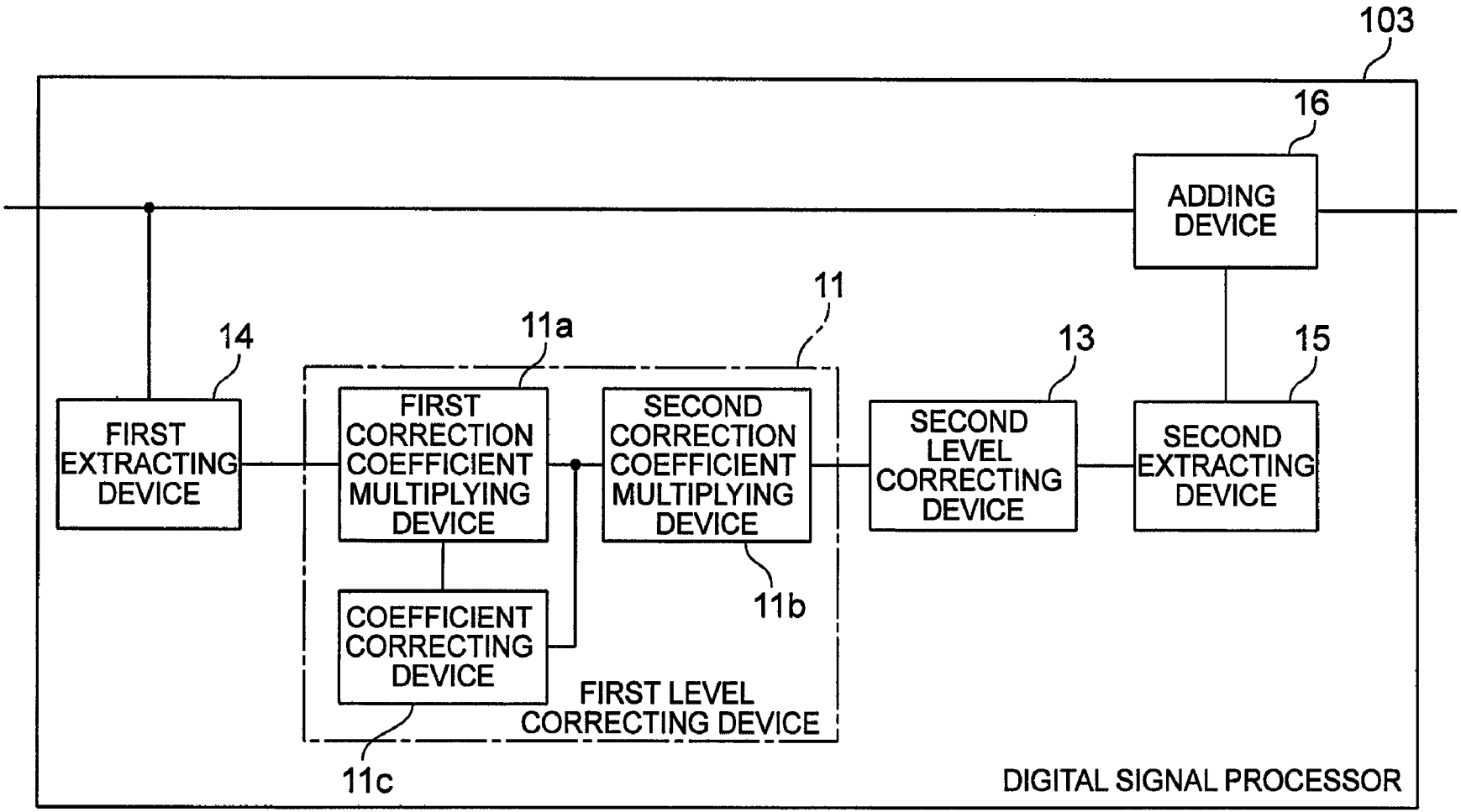
FIG. 6 A configuration diagram showing an example of a basic configuration of a digital signal processor according to the present invention.
Figure 7:
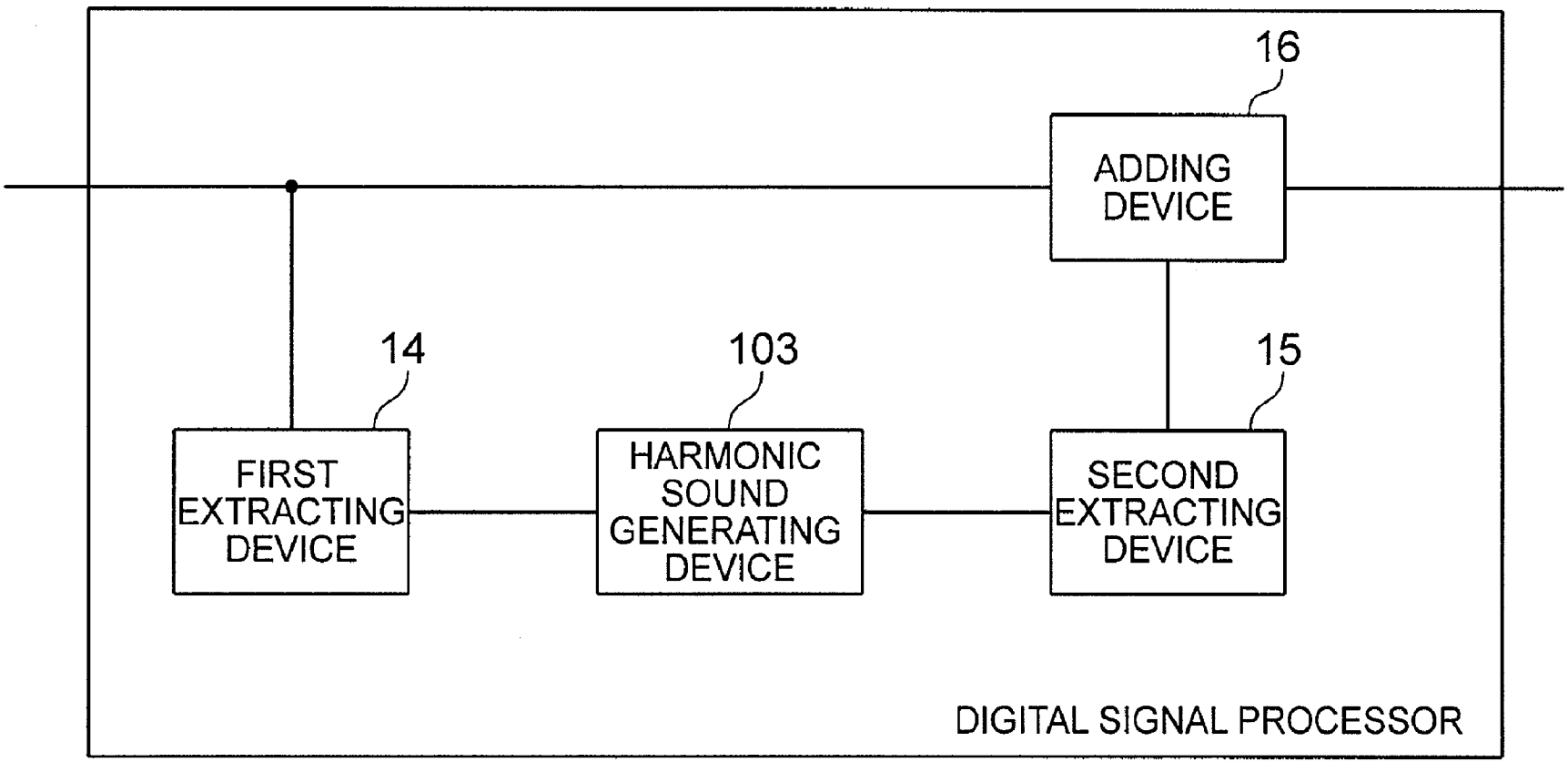
FIG. 7 A configuration diagram showing another example of a basic configuration of a digital signal processor according to the present invention.

Hereafter, embodiments of a harmonic sound generator and a digital signal processor according to the present invention will be explained with reference to FIGS. 4 to 7. Incidentally, FIGS. 4 and 5 are configuration diagrams showing an example of a basic configuration of the harmonic sound generator according to the present invention. FIGS. 6 and 7 are configuration diagrams showing an example of a basic configuration of the digital signal processor according to the present invention.

In FIG. 4, the harmonic sound generator includes:

a harmonic sound generating device 103 to suppress a signal level over a specific signal level of a music signal to the specific signal level, and to generate harmonic sound on the basis of the music signal;

a first level correcting device 11 to make the harmonic sound generating device 103 generate harmonic sound after correcting the signal level by multiplying the signal level by a correction coefficient so as to make the signal level of the music sound over the specific value; and a second level correcting device 13 to correct the signal level by multiplying the signal level in which harmonic sound has been generated by a reciprocal of the correction coefficient.

According to the above, even in the music signal of the small signal level, the signal level after corrected by the first level correcting device 11 is over the specific value. Therefore, the harmonic sound generating device 103 surely suppresses the signal level of the music signal to generate harmonic sound. Namely, harmonic sound is surely generated even on the basis of the music signal of the small signal level.

Further, in the harmonic sound generator, the harmonic sound generating device 103 may be composed of the digital signal processor to perform digital signal process with respect to the music signal and to suppress the signal level to the maximum value when the signal level over the maximum value of processable values is generated by the digital signal processor, and the specific value may be the maximum value.

According to the above, the digital signal processor for performing digital signal process with respect to various music signals can be used as the harmonic sound generating device 103. Further, because the specific value is the maximum value, the harmonic sound can be generated when the digital signal processor overflows. Therefore, the harmonic sound can be generated without arithmetic processing of the digital signal processor according to non-linear function, and the harmonic sound can be generated with a small arithmetic processing volume.

Further, in the harmonic sound generator, the first level correcting device 11 may be composed of the digital signal processor, and may include: a first correction coefficient multiplying device 11*a* to multiply the signal level of the music signal by a first correction coefficient; a second correction coefficient multiplying device 11*b* to further multiply the signal level multiplied by the first correction coefficient by a predetermined second correction coefficient; and a coefficient correcting device 11*c* to correct the first correction coefficient so as to make a difference between the signal level multiplied by the first correction coefficient and a predetermined target value divided by the second correction coefficient zero.

According to the above, the coefficient correcting device 11*c* corrects so as to make the signal level smaller than the target value (target value/second correction coefficient). Therefore, even if the target value is set to around the maximum value, by multiplying the signal level by the first correction coefficient, the signal level can be less than the maximum level. Resultingly, the coefficient correcting device 11*c* can correct the first correction coefficient without an effect of an overflow of the digital signal processor.

Further, the harmonic sound generator may include: a first extracting device 14 to extract only a specific frequency range from the music signal and supply the music signal of the specific frequency range to the first level correcting device 11;

a second extracting device 15 to extract only harmonic sound component by eliminating the specific frequency range from the music signal in which the harmonic sound component has been generated; and an adding device 16 to add the harmonic sound component corrected by the second level correcting device 13 to the music signal. According to the above, a specific frequency range is emphasized relative to the other frequency range composing the music signal.

As shown in FIG. 5, the harmonic sound generator includes: the harmonic sound generating device 103 to generate harmonic sound on the basis of a music signal; the first extracting device 14 to extract only a specific frequency range from the music signal, and to supply the music signal of the specific frequency range to the harmonic sound generating device; the second extracting device 15 to eliminate the specific frequency range from the music signal on which the harmonic sound is generated to extract only the harmonic sound; and the adding device 16 to add the harmonic sound extracted by the second extracting device to the music signal. According to the above, a specific frequency range is emphasized relative to the other frequency range composing the music signal.

As shown in FIG. 6, the digital signal processor performs digital signal process with respect to a music signal and suppresses a signal level to a maximum value when the signal level over the maximum value of processable values is generated by the digital signal processor. The digital signal processor includes: the first level correcting device 11 to correct the signal level and generate harmonic sound by multiplying the signal level of the music signal by a correction coefficient so as to make the signal level of the music signal over the maximum value; and the second level correcting device 13 to correct the signal level by multiplying the signal level of the music signal corrected by the first level correcting device 11 by a reciprocal of the correction coefficient.

According to the above, even in the music signal of the small signal level, the signal level after corrected by the first level correcting device 11 is over the maximum value of the digital signal processor. Therefore, the digital signal processor surely overflows to suppress the signal level of the music signal to generate harmonic sound. Namely, harmonic sound is surely generated even on the basis of the music signal of the small signal level. Further, because the harmonic sound can be generated when the digital signal processor overflows, the harmonic sound can be generated without arithmetic processing of the digital signal processor according to non-linear function, and the harmonic sound can be generated with a small arithmetic processing volume.

Further, in the digital signal processor, the first level correcting device 11 may include: the first correction coefficient multiplying device 11*a* to multiply the signal level of the music signal by the first correction coefficient; the second correction coefficient multiplying device 11*b* to further multiply the signal level multiplied by the first correction coefficient by the second correction coefficient; and the coefficient correcting device 11*c* to correct the first correction coefficient so as to make a difference between the signal level multiplied by the first correction coefficient and a predetermined target value divided by the second correction coefficient zero.

According to the above, the coefficient correcting device 11*c* corrects so as to make the signal level smaller than the target value (target value/second correction coefficient). Therefore, even if the target value is set to around the maximum value, by multiplying the signal level by the first correction coefficient, the signal level can be less than the maximum level. Resultingly, the coefficient correcting device 11*c* can correct the first correction coefficient without an effect of an overflow of the digital signal processor.

Further, the digital signal processor may include: the first extracting device 14 to extract only a specific frequency range from the music signal and supply the music signal of the specific frequency range to the first level correcting device 11; the second extracting device 15 to extract only harmonic sound component by eliminating the specific frequency range from the music signal in which the harmonic sound component has been generated; and the adding device 16 to add the harmonic sound component corrected by the second level correcting device 13 to the music signal. According to the above, a specific frequency range is emphasized relative to the other frequency range composing the music signal.

As shown in FIG. 7, the digital signal processor to perform digital signal process with respect to the music signal includes: the harmonic sound generating device 103 to generate harmonic sound on the basis of the music signal; the first extracting device 14 to extract only a specific frequency range, and to supply the music signal of the specific frequency range to the harmonic sound generating device 103; the second extracting device 15 to eliminate the specific frequency range from the music signal in which the harmonic sound has been generated to extract only the harmonic sound; and the adding device 16 to add the harmonic sound extracted by the second extracting device 15 to the music signal. According to the above, a specific frequency range is emphasized relative to the other frequency range composing the music signal.

Further, a method for generating harmonic sound according to an embodiment of the present invention includes the steps of correcting a signal level by multiplying the signal level of a music signal by a correction coefficient so as to make the signal level of the music signal over a specific value; suppressing the signal level of the music signal over the specific value to the specific value, and generating harmonic sound; and correcting the signal level by multiplying the signal level of the music signal in which harmonic sound has been generated by a reciprocal of the correction coefficient.

According to the above, even in the music signal of the small signal level, the signal level after corrected is over the specific value. Therefore, the signal level of the music signal is surely suppressed to generate harmonic sound. Namely, harmonic sound is surely generated even on the basis of the music signal of the small signal level.

Further, a method for generating harmonic sound according to another embodiment of the present invention includes the steps of extracting only a specific frequency range from a music signal; generating harmonic sound on the basis of the music signal of the specific frequency range; eliminating only the specific frequency range from the music signal in which the harmonic sound has been generated to extract only the harmonic sound; and adding the extracted harmonic sound to the music signal. According to the above, a specific frequency range is emphasized relative to the other frequency range composing the music signal.

Embodiment

Figure 8:
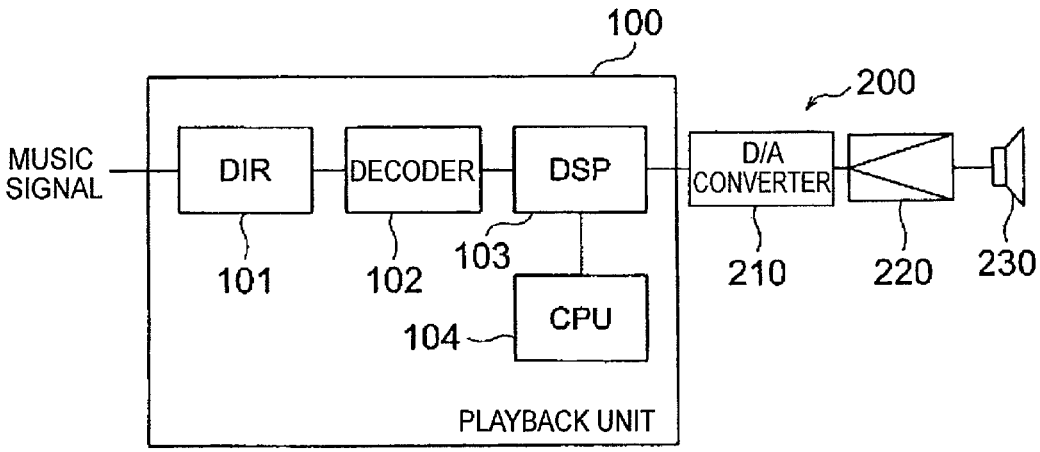
FIG. 8 A block diagram showing an embodiment of a playback unit in which a harmonic sound generator and a digital signal processor according to the present invention are embedded.

Next, an embodiment of a music playback unit in which the harmonic sound generator and the digital signal processor as described above are embedded will be explained. Incidentally, FIG. 8 is a block diagram showing the embodiment of the music playback unit in which the harmonic sound generator and the digital signal processor are embedded.

This music playback unit converts digital music signals recorded on a recording media such as DVD (Digital Versatile Disc), CD (Compact Disc), or a hard disk into signals to be reproduced by a speaker. An output unit 200 for reproducing processed music data is connected to this music playback unit 100.

The output unit 200 reproduce the music signal outputted from the music playback unit 100. This output unit 200 includes a digital to analog (D/A) converter 210, an amplifier 220, and a speaker 230. The D/A converter 210 is connected to the music playback unit 100, and converts the digital music signal outputted from the music playback unit 100 into the analog music signal. Then, the D/A converter 210 outputs the analog-converted music signal to the amplifier 220.

The amplifier 220 is connected to the D/A converter 210 and is also connected to the speaker 230. This amplifier 220 amplifies the analog music signal outputted from the D/A converter 210, and the speaker 230 outputs the amplified analog music signal.

The music playback unit 100 is composed of a DIR (Digital Interface Receiver) 101 into which the digital music signal read out from the above-described recording media is inputted, a decoder 102 for decoding the compressed music signal, a DSP 103 for various signal processing such as mixing or effect with respect to the decoded musical signal, and a CPU 104 for controlling the DSP 103.

The above-described DSP 103 overflows when a large signal level which is larger than the maximum value $x_{max}$ (=specific value) of the digital signal processable signal levels is generated, and suppress the signal level to the maximum value $x_{max}$. Normally, the signal level of the digital music signal is less than the maximum value $x_{max}$ of the DSP 103. Incidentally, above-described signal level is an absolute value.

Figure 9:
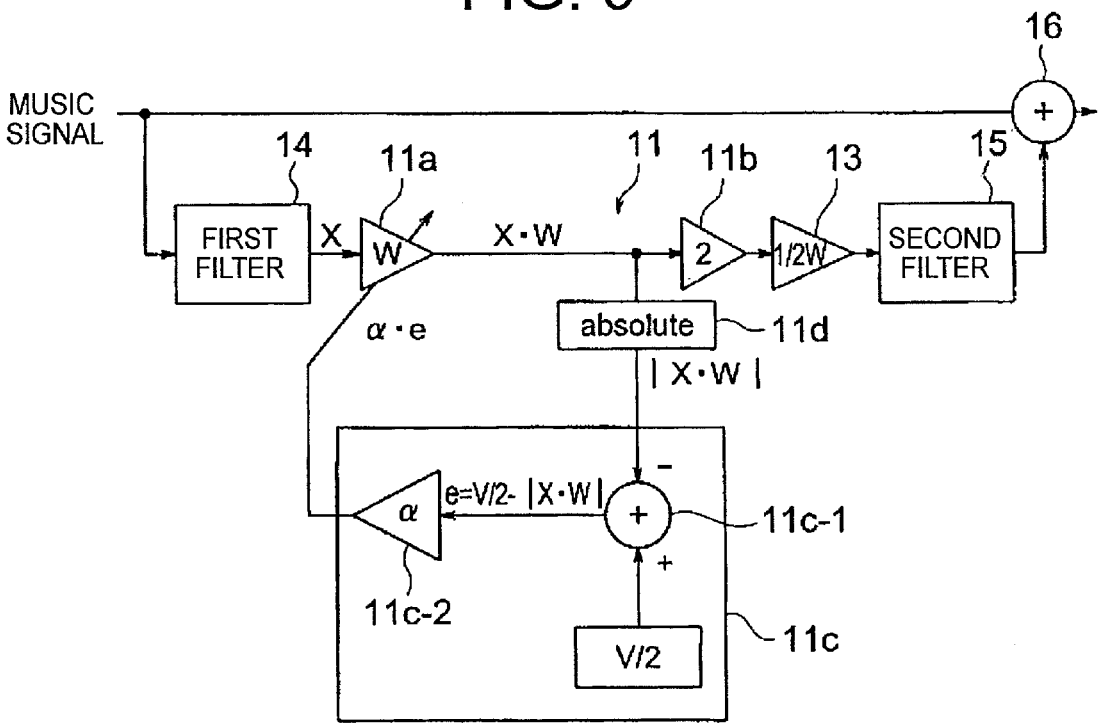
FIG. 9 A block diagram showing a configuration of a digital signal processor composing the playback unit shown in FIG. 8.

Next, a configuration of the above-described DSP 103 will be explained with reference to FIG. 9. The DSP103 is controlled by a program stored in a not-shown memory, and is composed of a first filter 14 as the first extracting device 14 to extract only a specific frequency range from the music signal, and a first level correcting unit 11 as the first level correcting device 11 to multiply the music signal by correction coefficient 2W so that the signal level of the music signal becomes over the maximum value $x_{max}$ of the DSP 103, a second level correcting unit 13 as the second level correcting device to multiply the signal level by a reciprocal of the correction coefficient 2W, a second filter 15 for extracting only a harmonic sound component by eliminating the specific frequency range from the music signal in which the harmonic sound component has been generated, and an adding unit 16 to add the original music signal to the harmonic sound component extracted by the second filter 15.

The first level correcting unit 11 includes: a first correction coefficient multiplying unit 11*a* as the first correction coefficient multiplying device to multiply the signal level x of the music signal by the first correction coefficient W; a second correction coefficient multiplying unit 11*b* as the second correction coefficient multiplying device to further multiply the signal level x multiplied by the first correction coefficient W (hereunder referred to as x*W) by 2 (=second correction coefficient); a coefficient correcting unit 11*c* as the coefficient correcting device to correct the first correction coefficient W so as to make the difference between x*W and a predetermined target value divided by 2 (=V/2) zero; and an absolute value unit 11*d* to output the absolute value of a product of signal level x multiplied by the first correction coefficient W (hereafter referred to as |x*W|). Incidentally, in this embodiment, the target value V is higher than the maximum value.

The above-described coefficient correcting unit 11*c* includes: a subtraction unit 11*c*-1 to subtract |x*W| from (V/2); and a correction unit 11*c*-2 to correct the first correction coefficient by adding the first correction coefficient W to the product α*e of the subtraction e (=(V/2)−|x*W|) multiplied by a step size α.

W(n) is defined as a first correction coefficient at the time when correcting (n−1) times by the correction unit 11*c*-2. W(n−1) is defined as the first correction coefficient at the time when correcting n times. Then, a relationship between W(n) and W(n−1) is shown in an equation (1). Incidentally, n is an arbitrary integer number.

$$W(n)=W(n-1)+\alpha*e=W(n-1)+\alpha*(V/2-|x*W|) \quad (1)$$

As it is clear from the equation (1), the coefficient correcting unit 11*c* corrects so that when |x*W| is larger than (V/2), α*e becomes negative value and the first correction coefficient W becomes smaller, and when |x*W| is smaller than (V/2), α*e becomes positive value and the first correction coefficient W becomes larger. Further, if the difference between |x*W| and (V/2) is large, α*e becomes large, and the large α*e is added to or subtracted from the first correction coefficient W. If the difference between |x*W| and (V/2) is small, α*e becomes small, and the small α*e is added to or subtracted from the first correction coefficient W. Namely, the coefficient correcting unit 11*c* corrects the first correction coefficient W so that |x*W| becomes be V/2. Thus, the signal level x of the music signal is corrected to come close to V/2 by the first correction coefficient multiplying unit 11*a*, and the signal level x of the music signal is corrected to come close to V by the second correction coefficient multiplying unit 11*b*.

Next, signal processing in the first and second level correcting units 11, 13 will be explained with reference to FIGS. 10A to 10D. FIG. 10A is a graph showing the signal level of a music signal before the first level correcting unit la corrects the signal level. FIG. 10B is a graph showing the signal level of the music signal after the first level correcting unit 11*a* corrects the signal level. FIGS. 10C and 10D are graphs showing the signal level of the music signal after the second level correcting unit 13 corrects the signal level. Incidentally, for ease of explanation, absolute value of the signal level is shown in FIGS. 10A to 10C.

Now, a sine wave music signal as shown in FIG. 10A is inputted into the DSP 103. Then, the first level correcting unit 11 corrects the signal level x by multiplying the signal level x by the correcting coefficient 2W so that the signal level x comes close to the target value V. Resultingly, as shown by a dotted line in FIG. 10B, the signal level x repeatedly overshoots and undershoots with respect to the target value V. The target value is set larger than the maximum value $x_{max}$. Therefore, by the first level correcting unit 11, a range over a threshold value K (see FIG. 10A, 10B) of the signal level are multiplied by the correction coefficient 2W to be over the maximum value $x_{max}$.

When the signal level is over the maximum value $x_{max}$, the DSP 103 overflows to suppress the signal level over the maximum value $x_{max}$ to the maximum value $x_{max}$. Accordingly, by the first level correcting unit 11, as shown in FIG. 10B, the range over the maximum value $x_{max}$ is distorted, and the music signal having the harmonic sound is attained. Then, the second level correcting unit 13 multiplies the signal level of the music signal shown in FIG. 10B by a reciprocal of the correcting coefficient 2W to return the signal level to the level before the first level correcting device 11 corrects. Thus, as shown in FIGS. 10C and 10D, the signal level over the threshold value K is distorted, and the music signal having the harmonic sound is attained. As it is clear from the above described, the DSP 103 corresponds to the harmonic sound generating device.

The threshold value K is determined by a relationship between the target value V and the maximum value $x_{max}$. Namely, as the target value increases, the threshold value K decreases and a ratio of the DSP103 overflowing increases. Incidentally, in this embodiment, the target value V is larger than the maximum value $x_{max}$. However, if the signal level overshoots the target value V and is over the maximum value $x_{max}$ due to the correction by the first level correcting unit 11, the target value V may be smaller than the maximum value $x_{max}$. Namely, the target value V is set so that the signal level of the music signal is over the maximum value $x_{max}$.

Figure 11A:
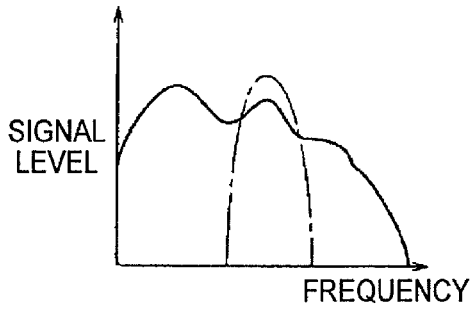
FIG. 11A A graph showing a frequency characteristic of a music signal before inputted into a first filter unit 14.
Figure 11B:
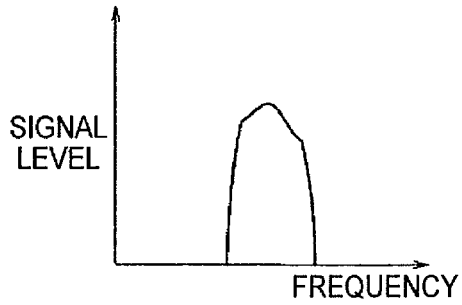
FIG. 11B A graph showing a frequency characteristic of the music signal after passing through the first filter unit 14.
Figure 11C:
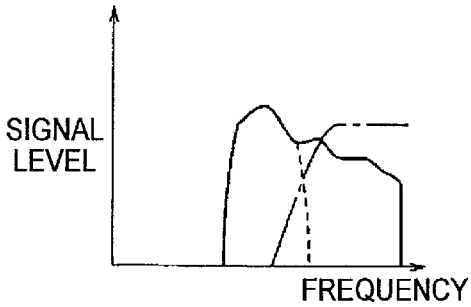
FIG. 11C A graph showing a frequency characteristic of the music signal after the first level correcting unit 11 corrects the signal level.
Figure 11D:
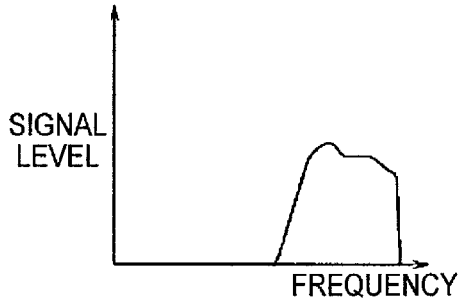
FIG. 11D A graph showing a frequency characteristic of the music signal after passing through a second filter 15.
Figure 11E:
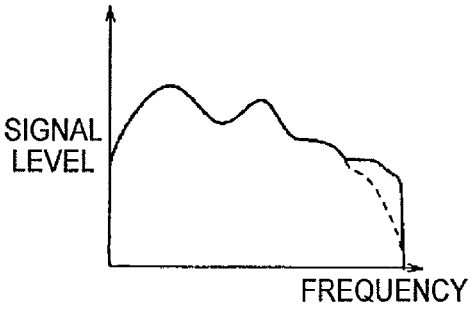
FIG. 11E A graph showing a frequency characteristic of the music signal after passing through an adding device 16.

A whole operation of the music playback unit 100 having the above described configuration will be explained with reference to FIG. 11. FIG. 11A is a graph showing a frequency characteristic of a music signal before inputted into a first filter unit 14. FIG. 11B is a graph showing a frequency characteristic of the music signal after passing through the first filter unit 14. FIG. 11C is a graph showing a frequency characteristic of the music signal after the first level correcting unit 11 corrects the signal level. FIG. 11D is a graph showing a frequency characteristic of the music signal after passing through a second filter 15. FIG. 11E is a graph showing a frequency characteristic of the music signal after passing through an adding device 16.

Firstly, the digital music signal read out from the recording media is inputted into the decoder 102 via the DIR 101. The decoder 102 decodes the coded music signal in a compression format such as MP3 or WMA, and supplies the decoded music signal to the DSP 103. When the music signal having a frequency characteristic shown in FIG. 11A is inputted into the first filter 14 in the DSP 103, the first filter 14 extracts only the specific frequency from the music signal, and makes the music signal only composed of the specific signal shown in FIG. 11B. Incidentally, the specific frequency as the first filter extracts is, for example, selected by a user from among a plurality of frequency ranges (vocal range, bass range, tenor range or the like). The CPU 104 controls the DSP 103 so as to extract the user selected frequency range.

Then, the harmonic sound component shown in FIG. 11C is generated in the music signal due to the first level correcting unit 11 and the second level correcting unit 12. Next, as shown in FIG. 11D, the second filter 15 eliminates the specific frequency range, and extracts only the harmonic sound components. Next, as shown in FIG. 11E, the adding unit 16 adds the original sound signal and the harmonic sound component extracted by the second filter 15. As shown in FIG. 11E, a harmonic sound component of a high frequency indicated by a dotted line can be added to the original frequency component. The music signal to which the harmonic sound is added is then processed and outputted to the D/A converter 210.

The D/A converter 210 converts the digital music signal to which the harmonic sound component is added into the analog music signal, and outputs to the speaker 230 via the amplifier 220. Then, the speaker 230 reproduce the music signal to which the harmonic sound is added.

According to the DSP 103 of the music playback unit 100, because the signal level is over the maximum value $x_{max}$ due to the level correction of the first level correcting unit 11, surely the DSP 103 overflows with respect to even the music signal of the small signal level, suppresses the signal level of the music signal, and generates the harmonic sound. Namely, even the music signal of the small signal level surely generates the harmonic sound. According to the above, because the signal level is over the maximum value $x_{max}$ due to the level correction of the first level correcting unit 11, surely the DSP 103 overflows with respect to even the music signal of the small signal level, suppresses the signal level of the music signal, and generates the harmonic sound. Namely, even the music signal of the small signal level surely generates the harmonic sound. Further, because the harmonic sound can be generated when the DSP 103 overflows. Therefore, the harmonic sound can be generated without arithmetic processing of the DSP 103 according to non-linear function, and the harmonic sound can be generated with a small arithmetic processing volume.

Further, according to the DSP 103 as described above, in the first level correcting unit 11, the correction coefficient 2W by which the signal level is multiplied is multiplied two times at the first correction coefficient multiplying unit 11*a* and at the second correction coefficient multiplying unit 11*b*. Then, the coefficient correcting unit 11*c* corrects the first correction coefficient W so that x*W is less than the target value V and becomes V/2. For example, if the first level correcting device 11 corrects the first correction coefficient W so that x*V becomes the target value V, at the time when the signal level is multiplied by the first correction coefficient W, the signal level is over the maximum value $x_{max}$, and the coefficient correcting unit 11*c* corrects the correction coefficient so that the difference between the maximum value and the target value is zero. Resultingly, the correction of the correction coefficient to make the difference between x*V and the target value zero cannot be carried out. However, according to this embodiment, even when the target value V is set around the maximum value $x_{max}$, at the time when the signal level is multiplied by the first correction coefficient W, the signal level can be less than the maximum value $x_{max}$. Resultingly, the coefficient correcting unit 11*c* can correct the first correction coefficient W without receiving an affect of the overflow of the DSP 103.

Further, according to the DSP 103 as described above, only a specific frequency range is extracted from the music signal via the first filter 14. Then, the harmonic sound is generated with respect to the music signal of the extracted specific frequency range. Then, the specific frequency range is eliminated via the second filter 15 to extract only the harmonic sound component. Lastly, the adding unit 16 adds the harmonic sound component to the original music signal. According to the above, a specific frequency range is emphasized relative to the other frequency range composing the music signal. For example, when the specific frequency range is set to be a vocal range, the vocal range is emphasized relative to the other frequency range of the music signal. When the specific range is set to be a bass range, the bass range is emphasized relative to the other frequency range of the music signal.

Incidentally, according to the above embodiment, the harmonic sound is generated due to the overflow of the DSP 103. However, the present invention is not limited to this. For example, the harmonic sound may be generated by embedding a program for operating a non-linear function as well as the input-output characteristic shown in FIG. 1 in the DSP 103. In this case, the specific value A in FIG. 1 is set to be less than the maximum value $x_{max}$, and the first level correcting device 11 corrects the signal level of the music signal by multiplying the signal level by the correction coefficient so that the signal level of the music signal becomes over the specific value A, thereby the harmonic sound is generated due to the non-linear operation of the DSP 103.

Further, when the specific value A is less than the maximum value $x_{max}$, the first level correcting unit 11 may be composed of a correction coefficient multiplying unit to multiply the signal level by the correction coefficient and a coefficient correcting unit for correcting the correction coefficient so as to make a difference between a product of multiplying the signal level by the correction coefficient and the target value zero.

Figure 1:
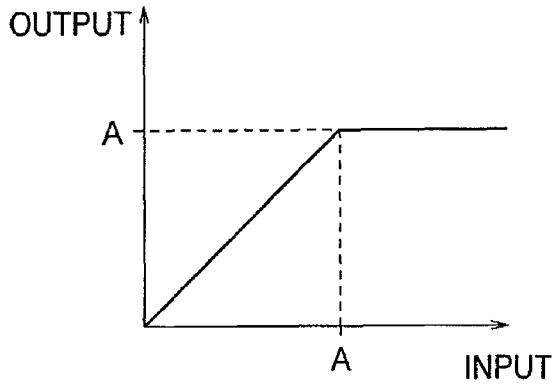
FIG. 1 A graph showing an input-output characteristic of a compressor conventionally used as a harmonic sound generator.
Figure 2A:
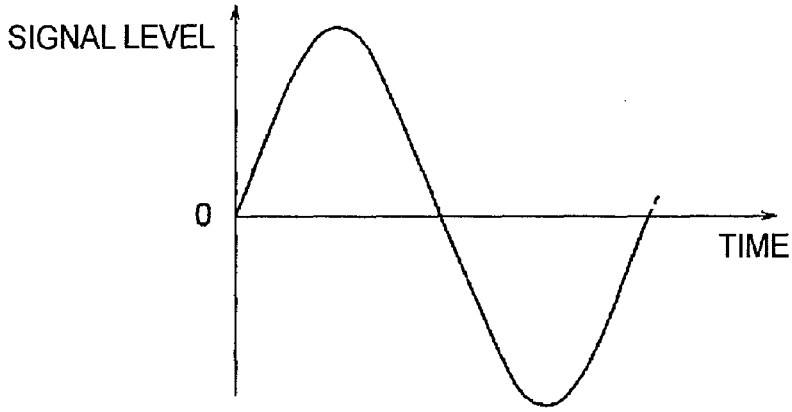
FIG. 2A A graph showing a music signal inputted into the compressor having the input-output characteristic of FIG. 1.
Figure 2B:
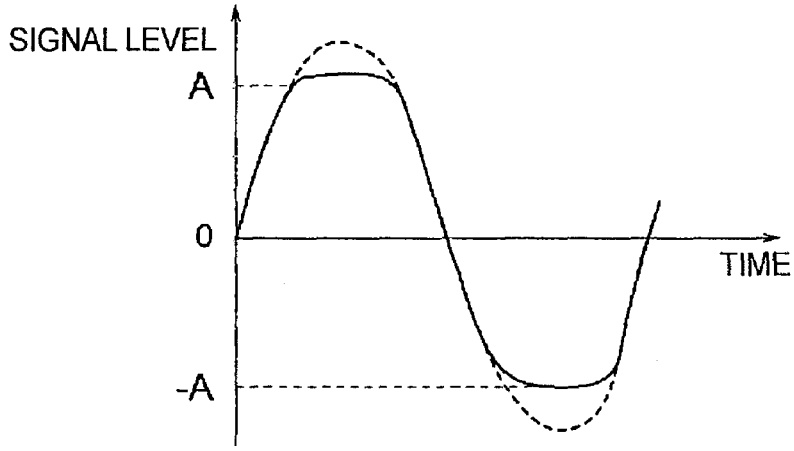
FIG. 2B A graph showing a music signal outputted from the compressor having the input-output characteristic of FIG. 1.
Figure 3:
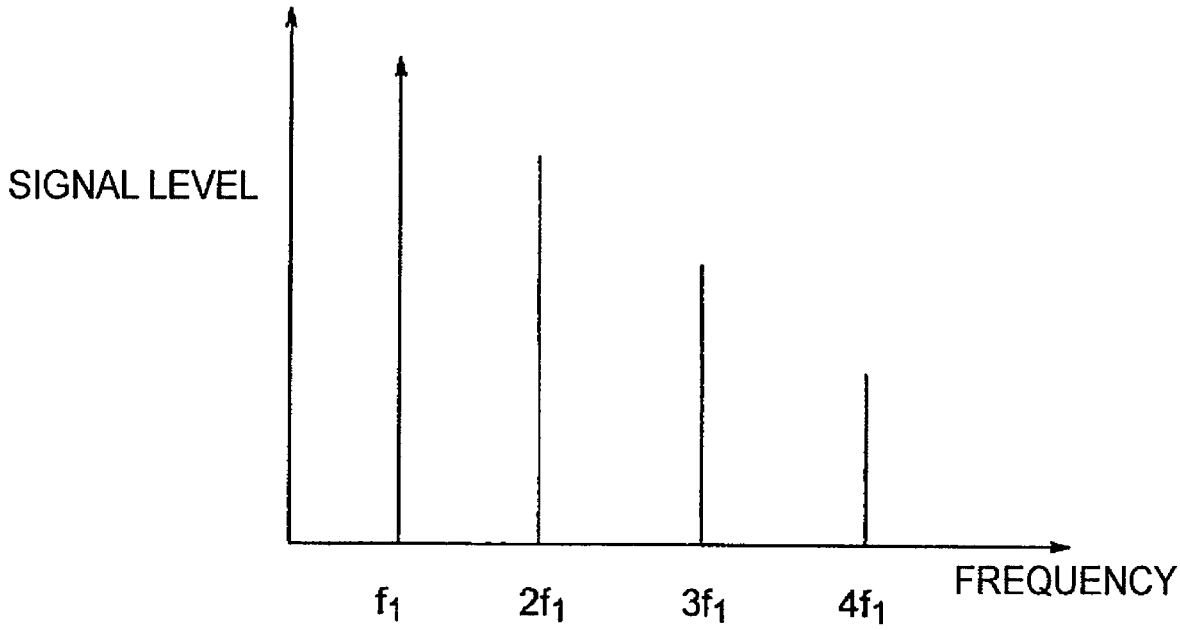
FIG. 3 A graph showing a relationship between a frequency and a signal level of the music signal shown in FIG. 2B.

Further, an analog compressor having the input-output characteristic shown in FIG. 1 may be used as the harmonic sound generator. In this case also, the specific value A in FIG. 1 is set to be less tan the maximum value $x_{max}$, and the first level correcting unit 11 of the DSP 103 corrects the signal level of the music signal by multiplying the signal level by the correction coefficient so as to make the signal level over the specific value A. Then, the music signal corrected by the first level correcting device 11 is D/A converted to the analog music signal. Then, the analog music signal is supplied to the analog compressor, thereby the harmonic sound is generated.

Further, according to the above embodiment, in the second correction coefficient multiplying unit 11*b*, two is multiplied as the second correction coefficient, however, the present invention is not limited to this. As the second correction coefficient, any value can be used as long as the target value V divided by the second correction coefficient is less than the maximum value $x_{max}$.

Further, according to the above embodiment, in the first level correcting unit 11 in the DSP 103, the first correction coefficient multiplying unit 11*a* multiplies the signal level of the music signal by the first correction coefficient W, and the second correction coefficient multiplying unit 11*b* further multiplies the signal level multiplied by the first correction coefficient W by 2, and the coefficient correcting unit 11*c* corrects the first correction coefficient W so as to make the difference between the signal level x multiplied by the first correction coefficient W and the target value V divided by 2 zero. However, the present invention is not limited to this. For example, the signal level may be multiplied by so large correction coefficient that the signal level of the threshold value K shown in FIG. 10A is surely over the maximum value $x_{max}$, so that the signal level of the music signal may be over the maximum value $x_{max}$.

Further, according to the above embodiment, the first and second level correcting units 11, 13 are composed of the DSP 103. However, the present invention is not limited to this. The first and second level correcting units 11, 13 may be composed of an analog circuit which works as same as the DSP 103.

Further, according to the above embodiment, in the first level correcting device, an error e is used as an evaluated value for moving the signal level x close to the target value V/2. However, the present invention is not limited to this. For example, as the evaluated value, a square error $e^2$ can be used, and the first correction coefficient W may be corrected so as to make the square error $e^2$ zero. Namely, as the first level correcting device, any algorism can be used unless it is against the object of the present invention.

Further, according to the above embodiment, the first and second level correcting units 11, 13 are provided, however, the present invention is not limited to this. For example, when a peak hold circuit for keeping a peak value of the music signal and generating the harmonic sound component is used as the harmonic sound generator, the first and second level correcting units 11, 13 are unnecessary. In this case, the harmonic sound generator may include: the first filter 14 for extracting only the specific frequency range from the music signal and supplying the music signal of the extracted specific frequency range to the harmonic signal generating unit such as the peak hold circuit; the second filter 15 for eliminating the specific frequency range from the music signal having the harmonic sound component and extracting only the harmonic sound component; and the adding unit 16 for adding the harmonic sound component extracted by the second filter 15 to the music signal.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A digital signal processor to perform digital signal process with respect to a music signal and to suppress a signal level to a maximum value when the signal level over the maximum value of processable values is generated by the digital signal processor, said digital signal processor comprising:

a first level correcting device to correct the signal level and generate harmonic sound by multiplying the signal level of the music signal by a correction coefficient so as to make the signal level of the music signal over the maximum value; and a second level correcting device to correct the signal level by multiplying the signal level of the music signal corrected by the first level correcting device by a reciprocal of the correction coefficient, wherein the first level correcting device includes:

a first correction coefficient multiplying device to multiply the signal level of the music signal by a first correction coefficient;

a second correction coefficient multiplying device to further multiply the signal level multiplied by the first correction coefficient by a predetermined second correction coefficient; and a coefficient correcting device to correct the first correction coefficient so as to make a difference between the signal level multiplied by the first correction coefficient and a predetermined target value divided by the second correction coefficient zero.

2. The digital signal processor as claimed in claim 1, further comprising:

a first extracting device to extract only a specific frequency range from the music signal and supply the music signal of the specific frequency range to the first level correcting device;

a second extracting device to extract only harmonic sound component by eliminating the specific frequency range from the music signal in which the harmonic sound component has been generated; and an adding device to add the harmonic sound component corrected by the second level correcting device to the music signal.

3. A method for generating harmonic sound by using a digital signal processor to perform digital signal process with respect to a music signal and to suppress a signal level to a maximum value when the signal level over the maximum value of processable values is generated by the digital signal processor, said method comprising the steps of:

a first step to generate the harmonic sound by correcting a signal level by multiplying the signal level of a music signal by a correction coefficient so as to make the signal level of the music signal over the maximum value; and a second step to correct the signal level by multiplying the signal level of the music signal in which harmonic sound has been generated by a reciprocal of the correction coefficient;

wherein in the first step, the digital signal processor multiplies the signal level of the music signal by a first correction coefficient, and further multiplies the signal level multiplied by the first correction coefficient by a second correction coefficient, and corrects the first correction coefficient so as to make a difference between the signal level multiplied by the first correction coefficient and a predetermined target value divided by the second correction coefficient zero.

* * * * *